US008679718B2

(12) United States Patent
Sugiura

(10) Patent No.: US 8,679,718 B2
(45) Date of Patent: Mar. 25, 2014

(54) TONER, TWO-COMPONENT DEVELOPER, AND IMAGE FORMING METHOD

(75) Inventor: Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/399,315

(22) Filed: Feb. 17, 2012

(65) Prior Publication Data

US 2012/0231387 A1 Sep. 13, 2012

(30) Foreign Application Priority Data

Mar. 11, 2011 (JP) ..... 2011-054213

(51) Int. Cl.
*G03G 9/00* (2006.01)

(52) U.S. Cl.
USPC ..... 430/110.2; 430/109.4

(58) Field of Classification Search
USPC ..... 430/108.7, 109.4, 110.2
See application file for complete search history.

(56) References Cited

U.S. PATENT DOCUMENTS 5,948,584 A * 9/1999 Hashimoto et al. ..... 430/109.3
7,664,439 B2 2/2010 Sugiura
8,007,976 B2 8/2011 Sugiura et al.
8,043,780 B2 10/2011 Sugiura et al.
2009/0220883 A1* 9/2009 Sugiura ..... 430/109.4
2011/0097659 A1* 4/2011 Sugiura et al. ..... 430/108.2
2011/0281209 A1 11/2011 Sugiura et al.
2011/0294064 A1 12/2011 Miyaake et al.

FOREIGN PATENT DOCUMENTS

JP 11-249339 9/1999
JP 2010-175933 8/2010

* cited by examiner

*Primary Examiner* — Stewart Fraser

(74) *Attorney, Agent, or Firm* — Oblon, Spivak, McClelland, Maier & Neustadt, L.L.P.

(57) ABSTRACT

A toner including a mother particle and an external additive is provided. The mother particle includes a core including a crystalline polyester, an amorphous polyester, a colorant, and a release agent; and a shell including resin particles. A deformation amount H1 of the toner compressed by a pressure of 0.5 mN under a temperature of 25° C. is between 0.2 and 1.5 μm. A difference D between the deformation amount H1 and a deformation amount H2 of the toner compressed by a pressure of 0.5 mN under a temperature of 50° C. is between 0.0 and 1.0 μm. A surface roughness Ra of the toner melted at 90° C. is between 0.02 and 0.40 μm.

10 Claims, 4 Drawing Sheets

TONER, TWO-COMPONENT DEVELOPER, AND IMAGE FORMING METHOD

CROSS-REFERENCE TO RELATED APPLICATIONS

This patent application is based on and claims priority pursuant to 35 U.S.C. §119 to Japanese Patent Application No. 2011-054213, filed on Mar. 11, 2011, in the Japanese Patent Office, the entire disclosure of which is hereby incorporated herein by reference.

TECHNICAL FIELD

The present disclosure relates to a toner, a developer, and an image forming method.

BACKGROUND

An electrophotographic or electrostatic image forming apparatus generally forms an image by taking the following steps: forming an electrostatic latent image on a photoreceptor, developing the electrostatic latent image into a toner image with a toner, transferring the toner image onto a recording medium, and fixing the toner image thereon by application of heat.

Toners are required to be fusible at much lower temperatures to meet recent demand for energy saving.

In place of vinyl resins having been widely used as toner binder, polyester resins are widely used recently because they are fusible and fixable on a recording medium at much lower temperatures. For example, Japanese Patent Application Publication No. 11-249339 proposes a toner including a crystalline polyester for the purpose of improving low-temperature fixability.

Generally, low-temperature fixability of toner can be improved by lowering the softening point of the toner, however it degrades heat-resistant storage stability. Such low-softening-point toner also contaminates and degrades developing members and carriers.

SUMMARY

Exemplary aspects according to embodiments of the present invention are put forward in view of the above-described circumstances, and provide a novel toner having a good combination of low-temperature fixability, heat-resistant storage stability, and development stability.

In one embodiment, a toner includes a mother particle and an external additive. The mother particle includes a core including a crystalline polyester, an amorphous polyester, a colorant, and a release agent; and a shell including resin particles. A deformation amount H1 of the toner compressed by a pressure of 0.5 mN under a temperature of 25° C. is between 0.2 and 1.5 μm. A difference D between the deformation amount H1 and a deformation amount H2 of the toner compressed by a pressure of 0.5 mN under a temperature of 50° C. is between 0.0 and 1.0 μm. A surface roughness Ra of the toner melted at 90° C. is between 0.02 and 0.40 μm.

In another embodiment, a two-component developer includes the above toner and a magnetic carrier.

In another embodiment, an image forming method includes the steps of forming a toner image on a recording medium with the above toner and fixing the toner image on the recording medium by applying a pressure of 5 to 90 N/cm$^2$ to the toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
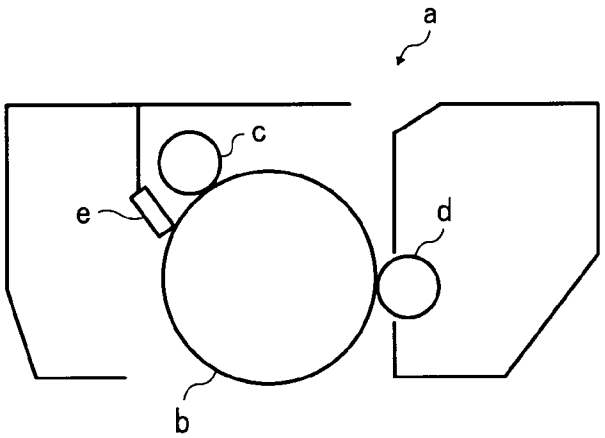
FIG. 1 is a schematic view illustrating a process cartridge according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

A toner according to an embodiment comprises a mother particle and an external additive. The mother particle includes a core including a crystalline polyester, an amorphous polyester, a colorant, and a release agent; and a shell including resin particles. A deformation amount H1 of the toner compressed by a pressure of 0.5 mN under a temperature of 25° C. is between 0.2 and 1.5 μm. A difference D between the deformation amount H1 and a deformation amount H2 of the toner compressed by a pressure of 0.5 mN under a temperature of 50° C. is between 0.0 and 1.0 μm. A surface roughness Ra of the toner melted at 90° C. is between 0.02 and 0.40 μm.

When the toner according to an embodiment is compressed by a pressure of 0.5 mN under a temperature of 25° C., a deformation amount H1 of the toner is between 0.2 and 1.5 μm. When the deformation amount H1 is less than 0.2 μm, it means the toner is so hard or stiff that the external additive easily releases from the toner. As a result, the toner may lose the functions of the external additive as spacer, fluidizer, and anti-sticking agent. When the deformation amount H1 is greater than 1.5 μm, it means that the toner is so soft that the external additive is easily buried in the toner. As a result, the toner may considerably deform or aggregate, or degrade carrier.

Additionally, a difference D between the deformation amount H1 and a deformation amount H2 of the toner compressed by a pressure of 0.5 mN under a temperature of 50° C. (i.e., D=H2−H1) is between 0.0 and 1.0 μm. When the difference D is greater than 1.0 μm, the toner may aggregate under high-temperature conditions. Also, such a toner may be undesirably fused or fixed on carrier or developing units.

In determining the deformation amounts H1 and H2, toner particles can be compressed by a stainless steel flat indenter, for example. The following is one example procedure for determining the deformation amounts using a flat indenter.

First, put a small amount of toner particles on a glass slide. Subject the toner particles to a tapping or blowing treatment so that the toner particles are isolated from each other and aggregations are loosened. Observe the toner particles with a microscope to randomly select 10 isolated toner particles. Measure the hardness of one selected toner particle with a pico indenter HM-500 (from Fischer Instruments K.K.) equipped with a 25 μm×25 μm stainless steel flat indenter. Compress the toner particles with the indenter at a pressure of 1 mN for 5 seconds, and subsequently draw up the indenter so that the pressure becomes 0.5 mM. Measure a deformation amount. Repeat this procedure for the 10 selected toner particles and average 10 measured values of deformation amount. During the measurement, the temperature is controlled by an air conditioner, a hot plate, or the like.

When the toner is melted at 90° C., the toner has a surface roughness Ra of 0.02 to 0.40 μm. When the surface roughness Ra is between 0.02 and 0.40 μm, it means that the toner expresses low-temperature fixability. When the surface roughness Ra is less than 0.02 μm, it means that the toner has high fusibility enough for providing a smooth image surface. However, such a toner may sometimes provide an excessively glossy surface. When the surface roughness Ra is greater than 0.40 μm, it means that the toner has poor fusibility. Such a toner is poorly adhesive to recording media and has poor storage stability.

The surface roughness Ra is measured based on a method according to JIS B 0601-2001 (ISO 4287-1997). For example, the surface roughness Ra can be determined by measuring a roughness curve of a three-dimensional shape of a sample with a confocal microscope and summing and averaging absolute deviation values of the roughness curve from the average line.

The following is one example procedure for determining the surface roughness Ra of a toner melted at 90° C. First, compress 30 mg of a toner contained in a container having an inner diameter of 5 mm with a load of 100 N for 1 minute to form the toner into a pellet having a diameter of 5 mm and a thickness of 1 mm. Heat the pellet from room temperature to 90° C. at a heating rate of 10° C./mim using a hearting stage for microscopes (from Japan High tech Co., Ltd.). After rapidly cool the heated pellet to room temperature with air, measure a roughness curve within a 100 μm×100 μm area on the pellet with a real color confocal microscope OPTELICS® 130 (from Lasertec Corporation) with an objective lens having a magnification of 100. Calculate the surface roughness Ra from the roughness curve.

The toner according to an embodiment has a core-shell structure in which the core includes a crystalline polyester, an amorphous polyester, a colorant, and a release agent, and the shell includes resin particles. The shell prevents the core components, such as the release agent, the colorant, and other components fusible at low temperatures, from contaminating and degrading carrier or developing members. The core can include, for example, a resin which can soften at low temperatures so that the toner provides low-temperature fixability. In some embodiments, the shell has a thickness of 0.01 to 2 μm. When the shell thickness is less than 0.01 μm, the shell cannot produce its effect. When the shell thickness is greater than 2 μm, the colorant and the release agent, both contained in the core, cannot produce their effect, or low-temperature fixability deteriorates.

The following is one example procedure for measuring the shell thickness.

First, embed one spatula of toner particles in an epoxy resin. Expose it to ruthenium tetroxide gas for 5 minutes to make the core and shell distinguishable according to the degree of dyeing. Cut the epoxy resin block into a ultrathin section (having a thickness of about 200 nm) with a ultra microtome ULTRACUT UCT (from Leica) with a diamond knife. Observe 10 randomly-selected toner particles existing in the ultrathin section with a transmission electron microscope H7000 (from Hitachi High-Tecnologies Corporation). Measure each shell thickness of the 10 randomly-selected toner particles and averaging 10 measured thickness values.

The toner according to an embodiment includes resin particles in the shell. For example, the toner may be produced in an aqueous medium containing resin particles so that the resin particles form the shell of the resultant toner. Surface hardness and fixability of the toner generally depend on properties of the resin particles.

In some embodiments, the resin particles have a glass transition temperature (Tg) of 40 to 100° C. and a weight average molecular weight of 9,000 to 200,000. When the glass transition temperature (Tg) is less than 40° C. and/or the weight average molecular weight is less than 9,000, the toner has poor storage stability which may cause blocking when stored in a container or a developing device. When the glass transition temperature (Tg) is greater than 100° C. and/or the weight average molecular weight is greater than 200,000, the resin particles may be poorly adhesive to paper, resulting in deterioration of low-temperature fixability.

In some embodiments, the toner includes the resin particles in an amount of 0.5 to 5.0% by weight. When the amount is less than 0.5% by weight, the toner has poor storage stability which may cause blocking when stored in a container or a developing device. When the amount is greater than 5.0% by weight, the resin particles may inhibit exuding of the release agent from the core, resulting in deterioration of offset resistance. The amount of the resin particles can be determined by analyzing the toner with a pyrolysis gas chromatography mass spectrometer and measuring the peak area corresponding to the resin particles observed in the resulting chromatogram.

The resin particles may be comprised of either a thermoplastic resin or a thermosetting resin so long as the resin particles are capable of forming an aqueous dispersion thereof. Specific examples of usable resins include, but are not limited to, vinyl resins, polyurethane resins, epoxy resins, polyester resins, polyamide resins, polyimide resins, silicone resins, phenol resins, melamine resins, urea resins, aniline resins, ionomer resins, and polycarbonate resins. Two or more of these resins can be used in combination. Vinyl resins, polyurethane resins, epoxy resins, polyester resins, and combinations thereof are easy to form an aqueous dispersion of fine spherical particles thereof.

Specific examples of usable vinyl resins include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The toner according to an embodiment includes a crystalline polyester. In some embodiments, the crystalline polyester has a melting point of 50 to 100° C., 55 to 90° C., or 60 to 85° C. When the melting point is less than 50° C., storage stability of the toner and the resulting toner image may be poor. When the melting point is greater than 100° C., low-temperature fixability of the toner may be poor. The melting point of the crystalline polyester can be determined from an endothermic peak temperature observed in a differential scanning calorimetry.

In this specification, the crystalline polyester includes both a polymer consists of polyester units only and a copolymer of a polyester unit with at most 50% by weight of another polymer unit.

The crystalline polyester is obtained from a polycondensation reaction between a polycarboxylic acid and a polyol. Either a commercially-available product or a laboratory-derived product of the crystalline polyester is usable.

Specific examples of usable polycarboxylic acids include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, mesaconic acid, and dibasic acids; and anhydrides and lower alkyl esters thereof.

Additionally, tri- or more valent polycarboxylic acids such as 1,2,4-benzenetricarboxylic acid, 1,2,5-benzenetricarboxylic acid, and 1,2,4-naphthalenetricarboxylic acid, and anhydrides and lower alkyl esters thereof are also usable. Two or more of these materials can be used in combination.

Dicarboxylic acids having a sulfonic group or a double bond are also usable in combination with the above-described aliphatic and aromatic dicarboxylic acids.

Specific examples of usable polyols include, but are not limited to, aliphatic diols such as straight-chain aliphatic diols having 7 to 20 carbon atoms in the main chain. When a branched-chain aliphatic diol is used, crystallinity and melting point of the resulting polyester may be too low. When a straight-chain aliphatic diol having less than 7 carbon atoms in the main chain is reacted with an aromatic dicarboxylic acid, melting point of the resulting polyester may be too high to be fixable at low temperatures. Straight-chain aliphatic diols having greater than 20 carbon atoms in the main chain are difficult to obtain. In some embodiments, straight-chain aliphatic diols having 7 to 14 carbon atoms in the main chain are used.

Specific examples of usable aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these materials, 1,8-octanediol, 1,9-nonanediol, and 1,10-decanediol are easily available.

Additionally, tri- or more valent polyols such as glycerin, trimethylolethane, trimethylolpropane, and pentaerythritol are also usable. Two or more of these materials can be used in combination.

In some embodiments, the polyol comprises the aliphatic diol in an amount of 80% by mole or more, or 90% by mole or more. When the amount of the aliphatic diol is less than 80% by mole, crystallinity and melting point of the resulting polyester may be too low, thereby degrading toner blocking resistance, storage stability, and low-temperature fixability.

In order to adjust acid value and/or hydroxyl value, polycarboxylic acids and/or polyols may be added in the final stage of the polycondensation reaction. Specific examples of usable polycarboxylic acids include, but are not limited to, aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid.

Specific examples of usable polyols include, but are not limited to, aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adduct of bisphenol A and propylene oxide adduct of bisphenol A.

The polycondensation reaction for producing the crystalline polyester is performed at a temperature of 180 to 230° C. while removing the produced water or alcohol as byproducts and optionally reducing the pressure.

When monomers are incompatible with each other under the reaction temperature, a high-boiling-point solvent can be used as a solubilization agent. In this case, the polycondensation reaction is performed while removing the solubilization agent. When copolymerizing a main monomer with a poorly-compatible monomer, the poorly-compatible monomer may be previously reacted with an acid or an alcohol to be reacted with both monomers, in advance of the reaction with the main monomer.

A catalyst can be used in the reaction for producing polyesters. Specific examples of usable catalysts include, but are not limited to, compounds of alkaline metals such as sodium and lithium; compounds of alkaline-earth metals such as magnesium and calcium; compounds of metals such as manganese, antimony, titanium, tin, zirconium, and germanium; phosphorous acid compounds; phosphate compounds; and amine compounds.

More specifically, usable catalysts include, but are not limited to, sodium acetate, sodium carbonate, lithium acetate, lithium carbonate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenyl phosphonium bromide, triethylamine, and triphenylamine.

In some embodiments, the crystalline polyester has an acid value (i.e., the amount (mg) of KOH needed for neutralizing 1 g of the sample) of 3.0 to 30.0 mgKOH/g, 6.0 to 25.0 mgKOH/g, or 8.0 to 20.0 mgKOH/g.

When the acid value is less than 3.0 mgKOH/g, dispersibility in water may be poor. Such a resin is difficult to use in wet granulation processes. Also, such a resin is too unstable to effectively produce toner particles. When the acid value is greater than 30.0 mgKOH/g, the resulting toner may be too hygroscopic to be resistant to environmental conditions.

In some embodiments, the crystalline polyester has a weight average molecular weight (Mw) of 6,000 to 35,000. When the weight average molecular weight (Mw) is less than 6,000, the toner may undesirably penetrate into the surface of a recording medium, resulting in a non-uniform toner image. Also, a fixed toner image may be poorly resistant to folding. When the weight average molecular weight (Mw) is greater than 35,000, the toner may need to be heated to a high temperature so as to express a proper viscosity to be fusible on a recording medium, resulting in deterioration of low-temperature fixability.

The weight average molecular weight (Mw) can be measured by a gel permeation chromatography (GPC), for example, using a GPC instrument HLC-8120 (from Tosoh Corporation) and columns TSKgel Super HM-M (15 cm, from Tosoh Corporation) with THF solvent. The weight average molecular weight is determined from the resulting chromatogram and a molecular weight calibration curve complied from monodisperse polystyrene standard samples.

In some embodiments, the toner includes the crystalline polyester in an amount of 3 to 60% by weight, 4 to 50% by weight, or 5 to 30% by weight. When the content of the crystalline polyester is less than 3% by weight, the toner may have poor low-temperature fixability. When the content of the crystalline polyester is greater than 60% by weight, the toner strength, image strength, and/or chargeability may be poor.

In some embodiments, the crystalline polyester comprises 50% by weight or more of a crystalline polyester produced from aliphatic monomers. In this case, the crystalline polyester produced from aliphatic monomers includes the aliphatic monomer units in an amount at least 60% by mole, or at least 90% by mole. As described above, usable aliphatic monomers include aliphatic diols and dicarboxylic acids.

The toner according to an embodiment includes an amorphous polyester. In some embodiments, the toner includes both an amorphous modified polyester and an amorphous unmodified polyester.

Specific examples of usable amorphous modified polyesters include, but are not limited to, urea-modified polyesters. An urea-modified polyester may be obtained from a polyester prepolymer having an isocyanate group. A polyester prepolymer (A) having an isocyanate group may be a reaction product of a polyester having an active hydrogen group with a polyisocyanate (3). The polyester is a polycondensation product of a polyol (1) with a polycarboxylic acid (2). The active hydrogen group may be, for example, a hydroxyl group (e.g., an alcoholic hydroxyl group, a phenolic hydroxyl group), an amino group, a carboxyl group, or a mercapto group.

The following is one example procedure for preparing an amorphous modified polyester. First, heat a polyol (1) and a polycarboxylic acid (2) to between 150 and 280° C. in the presence of an esterification catalyst (e.g., tetrabutoxy titanate, dibutyltin oxide), while optionally reducing pressure. Remove the produced water to obtain a polyester having a hydroxyl group. React the polyester having a hydroxyl group with a polyisocyanate (3) at 40 to 140° C., to obtain a prepolymer (A) having an isocyanate group.

The polyol (1) may be, for example, a diol (1-1) or a polyol (1-2) having 3 or more valences. In some embodiments, a diol (1-1) alone or a mixture of a diol (1-1) with a small amount of a polyol (1-2) having 3 or more valences are used. Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. In some embodiments, an alkylene glycol having 2 to 12 carbon atoms or an alkylene oxide adduct of a bisphenol is used. In some embodiments, a mixture of an alkylene oxide adduct of a bisphenol and an alkylene glycol having 2 to 12 carbon atoms is used. Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

The polycarboxylic acid (2) may be, for example, a dicarboxylic acid (2-1) or a polycarboxylic acid (2-2) having 3 or more valences. In some embodiments, a dicarboxylic acid (2-1) alone or a mixture of a dicarboxylic acid (2-1) with a small amount of a polycarboxylic acid (2-2) having 3 or more valences are used. Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). In some embodiments, an alkenylene dicarboxylic acid having 4 to 20 carbon atoms or an aromatic dicarboxylic acid having 8 to 20 carbon atoms is used. Specific examples of the polycarboxylic acid (2-2) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (2).

In some embodiments, the equivalent ratio [OH]/[COOH] of hydroxyl groups [OH] in the polyol (1) to carboxyl groups [COOH] in the polycarboxylic acid (2) is 2/1 to 1/1, 1.5/1 to 1/1, or 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these compounds can be used in combination.

In some embodiments, the equivalent ratio [NCO]/[OH] of isocyanate groups [NCO] in the polyisocyanate (3) to hydroxyl groups [OH] in the polyester resin having a hydroxyl group is 5/1 to 1/1, 4/1 to 1.2/1, or 2.5/1 to 1.5/1. When the equivalent ratio [NCO]/[OH] is greater than 5, low-temperature fixability of the resulting toner may be poor. When the equivalent ratio [NCO]/[OH] is less than 1, hot offset resistance of the resulting toner may be poor because the content of urea in the urea-modified polyester is too small. In some embodiments, the polyester prepolymer (A) having an isocyanate group includes units from the polyisocyanate (3) in an amount of 0.5 to 40% by weight, 1 to 30% by weight, or 2 to 20% by weight. When the ratio of the polyisocyanate (3) units is less than 0.5% by weight, hot offset resistance, heat-resistant storage stability, and low-temperature fixability of the resulting toner may be poor. When the ratio of the polyisocyanate (3) units is greater than 40% by weight, low-temperature fixability of the resulting toner may be poor.

In some embodiments, the average number of isocyanate groups included in one molecule of the polyester prepolymer (A) having an isocyanate group is 1 or more, 1.5 to 3, or 1.8 to 2.5. When the average number of isocyanate groups is less than 1, hot offset resistance of the resulting toner may be poor because the molecular weight of the resulting urea-modified polyester is too small.

The polyester prepolymer (A) is cross-linked and/or elongated with an amine (B). The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. In some embodiments, a diamine (B1) alone or a mixture of a diamine (B1) with a small amount of a polyamine (B2) having 3 or more valences is used.

To control the molecular weight of the resulting urea-modified polyester, a reaction terminator can be used. Specific examples of usable reaction terminators include, but are not limited to, monoamines (e.g., diethylamine, dibutylamine, butylamine, laurylamine) and blocked monoamines (e.g., ketimine compounds). In some embodiments, the equivalent ratio [NCO]/[NHx] of isocyanate groups [NCO] in the polyester prepolymer (A) to amino groups [NHx] in the amine (B) is 1/2 to 2/1, 1/1.5 to 1.5/1, or 1/1.2 to 1.2/1. When the equivalent ratio [NCO]/[NHx] is greater than 2 or less than ½, hot offset resistance of the resulting toner may be poor because the molecular weight of the resulting urea-modified polyester is too small.

In some embodiments, the toner further includes an amorphous unmodified polyester (C) other than an amorphous modified polyester obtainable from the polyester prepolymer having an isocyanate group (A). The combination of the amorphous modified polyester and the amorphous unmodified polyester (C) improves low-temperature fixability of the toner and gloss of the resulting image. Similar to the polyester prepolymer (A) having an isocyanate group, the amorphous unmodified polyester (C) may be a polycondensation product of the above-described polyol (1) with the above-described polycarboxylic acid (2). The polyester prepolymer (A) having an isocyanate group and the amorphous unmodified polyester (C) may be at least partially compatible with each other to improve low-temperature fixability and hot offset resistance of the toner. In this case, the polyester prepolymer (A) having an isocyanate group and the amorphous unmodified polyester (C) have a similar chemical composition. In some embodiments, the weight ratio of the polyester prepolymer (A) having an isocyanate group to the amorphous unmodified polyester (C) is 5/95 to 75/25, 10/90 to 25/75, 12/88 to 25/75, or 12/88 to 22/78. When the weight ratio of the polyester prepolymer (A) is less than 5%, hot offset resistance, heat-resistant storage stability, and low-temperature fixability of the resulting toner may be poor.

In some embodiments, the amorphous unmodified polyester (C) has a peak molecular weight of 1,000 to 30,000, 1,500 to 10,000, or 2,000 to 8,000. When the peak molecular weight is less than 1,000, heat-resistant storage stability of the toner may be poor. When the peak molecular weight is greater than 10,000, low-temperature fixability of the toner may be poor. In some embodiments, the amorphous unmodified polyester (C) has a hydroxyl value of 5 mgKOH/g or more, 10 to 120 mgKOH/g, or 20 to 80 mgKOH/g. When the hydroxyl value is less than 5, hot offset resistance and low-temperature fixability of the resulting toner may be poor. In some embodiments, the amorphous unmodified polyester (c) has an acid value of 0.5 to 40 mgKOH/g or 5 to 35 mgKOH/g. Within the above range, the resulting toner may be negatively chargeable. When the acid and hydroxyl values are beyond the above-described range, the toner may produce defective images in high-temperature and high-humidity conditions or low-temperature and low-humidity conditions.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination. In some embodiments, the content of the colorant in the toner is 1 to 15% by weight or 3 to 10% by weight.

The colorant may be combined with a resin to be used as a master batch. Specific examples of usable resins for the master batch include, but are not limited to, the above-described modified and unmodified polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch may be obtained by mixing and kneading a resin and a colorant while applying a high shearing force. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

Specific examples of usable release agents include, but are not limited to, polyolefin waxes (e.g., polyethylene wax, polypropylene wax), long-chain hydrocarbons (e.g., paraffin wax, SASOL wax), and carbonyl-group-containing waxes. In some embodiments, carbonyl-group-containing waxes are used. Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenylamide), polyalkyl amides (e.g., trimellitic acid tristearylamide), and dialkyl ketones (e.g., distearyl ketone). In some embodiments, polyalkanoic acid esters are used. In some embodiments, the release agent has a melting point of 40 to 160° C., 50 to 120° C., or 60 to 90° C. When the melting point is less than 40° C., heat-resistant storage stability of the toner may be poor. When the melting point is greater than 160° C., cold offset resistance of the toner may be poor. In some embodiments, the release agent has a melt-viscosity of 5 to 1,000 cps or 10 to 100 cps, at a temperature 20° C. higher than the melting point. When the melt-viscosity is greater than 1,000 cps, hot offset resistance and low-temperature fixability of the toner may be poor. In some embodiments, the content of the release agent in the toner is 0 to 40% by weight or 3 to 30% by weight.

The toner according to an embodiment may further include a charge controlling agent. Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

In some embodiments, the content of the charge controlling agent is 0.1 to 10 parts by weight or 0.2 to 5 parts by weight, based on 100 parts by weight of the binder resin. When the content of charge controlling agent is greater than 10 parts by weight, the toner may be excessively charged, thereby being electrostatically attracted to a developing roller. As a result, fluidity of the developer and the resulting image density may deteriorate. The charge controlling agent may be directly mixed with the binder resin or the master batch, or added to an organic solvent containing such toner components. Alternatively, the charge controlling agent may be fixed on the surface of the resulting toner particles.

The toner according to an embodiment includes an external additive that improves fluidity, developability, and chargeability of the toner. The external additive may be comprised of, for example, fine particles of inorganic materials or hydrophobized inorganic materials. In some embodiments, the toner includes at least one kind of particulate hydrophobized inorganic material having an average primary particle diameter of 1 to 100 nm or 5 to 70 nm. In other embodiments, the toner includes at least one kind of particulate hydrophobized inorganic material having an average primary particle diameter of 20 nm and at least one kind of particulate hydrophobized inorganic material having an average primary particle diameter of 30 nm or more. In some embodiments, the fine particles have a BET specific surface of 20 to 500 $m^2/g$.

Additionally, fine particles of silica, hydrophobized silica, metal salts of fatty acids (e.g., zinc stearate, aluminum stearate), metal oxides (e.g., titania, alumina, tin oxide, antimony oxide), and fluoro polymers are also usable.

In some embodiments, the toner includes fine particles of hydrophobized silica, titania, titanium oxide, or alumina. Specific examples of commercially available silica particles include, but are not limited to, HDK H 2000, HDK H 2000/4, HDK H 2050EP, HVK 21, and HDK K 1303 (from Hoechst AG); and R972, R974, RX200, RY200, R202, R805, and R812 (from Nippon Aerosil Co., Ltd.). Specific examples of commercially available titania particles include, but are not limited to, P-25 (from Nippon Aerosil Co., Ltd.); STT-30 and STT-65C-S (from Titan Kogyo, Ltd.); TAF-140 (from Fuji Titanium Industry Co., Ltd.); and MT-150W, MT-500B, MT-600B, and MT-150A (from TAYCA Corporation). Specific examples of commercially available hydrophobized titanium oxide particles include, but are not limited to, T-805 (from Nippon Aerosil Co., Ltd.); STT-30A and STT-65S-S (from Titan Kogyo, Ltd.); TAF-500T and TAF-1500T (from Fuji Titanium Industry Co., Ltd.); MT-100S and MT-100T (from TAYCA Corporation); and IT-S (from Ishihara Sangyo Kaisha, Ltd.).

Fine particles of oxides, silica, titania, and alumina ma be hydrophobized with a silane coupling agent, such as methyltrimethoxysilane, methyltriethoxysilane, and octyltrimethoxysilane. Alternatively, the fine particles may be treated with a silicon oil upon application of heat.

Specific examples of usable silicone oils include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified or methacrylic-modified silicone oil, and α-methylstyrene-modified silicone oil. Specific examples of usable inorganic materials include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In some embodiments, the toner includes silica or titanium dioxide.

In some embodiments, the content of the external additive in the toner is 0.1 to 5% by weight or 0.3 to 3% by weight. In some embodiments, inorganic fine particles have an average primary particle diameter of 100 nm or less or 3 to 70 nm. When the average primary particle diameter is too small, the inorganic fine particles may be buried in the toner without produce their effect. When the average primary particle diameter is too large, the inorganic fine particles may damage the photoreceptor non-uniformly.

Additionally, fine particles of polymers (e.g., polystyrene, copolymers of methacrylates or acrylates) prepared by soap-free emulsion polymerization, suspension polymerization, or dispersion polymerization; polycondensation polymers (e.g., silicone, benzoguanamine, nylon); and thermosetting resins are also usable as the external additive.

The surface of the external additive may be hydrophobized so as to prevent deterioration of fluidity and chargeability even under high-humidity conditions. Specific examples of usable surface treatment agents include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from a photoreceptor or a primary transfer medium when remaining thereon after image transfer. Specific examples of suitable cleanability improving agents include, but are not limited to, metal salts of fatty acids (e.g., zinc stearate, calcium stearate), and fine particles of polymers prepared by soap-free emulsion polymerization (e.g., polymethyl methacrylate, polystyrene). In some embodiments, fine particles of polymers have a narrow size distribution and a volume average particle diameter of 0.01 to 1 μm.

The toner according to an embodiment has an average circularity E of 0.93 to 0.99, which means that the toner has a nearly spherical shape suitable for securing a core-shell structure. The average circularity E is defined by the following formula:

$$E(\%)=Cs/Cp\times 100\ ,$$

wherein Cp represents a peripheral length of a projected image of a particle and Cs represents a peripheral length of a circle having the same area as the projected image of the particle. The average circularity may be determined using a flow particle image analyzer FPIA-2100 (from Sysmex Corporation) and an analysis software FPIA-2100 Data Processing Program for FPIA version 00-10) as follows. First, charge a 100-mL glass beaker with 0.1 to 0.5 mL of a 10% surfactant (an alkylbenzene sulfonate NEOGEN SC-A from Dai-ichi Kogyo Seiyaku Co., Ltd.). Add 0.1 to 0.5 g of a toner to the beaker and mix with a micro spatula. Further add 80 mL of ion-exchange water to the beaker. Subject the resulting dispersion to a dispersion treatment for 3 minutes using an ultrasonic disperser (from Honda Electronics). Measure a shape distribution by FPIA-2100 when the dispersion has a concentration of 5,000 to 15,000 particles per micro-liter.

In terms of measurement reproducibility, it is important to measure a shape distribution when the dispersion has a concentration of 5,000 to 15,000 particles per micro-liter. To make the dispersion have the desired concentration, the amount of surfactant or toner included in the dispersion may be varied. When the amount of surfactant in the dispersion is too large, noisy bubbles are undesirably generated. When the amount of surfactant in the dispersion is too small, toner particles cannot sufficiently get wet or dispersed. The proper amount of toner in the dispersion depends on particle diameter of toner. The smaller the particle diameter of toner, the smaller the proper amount of the toner. When a toner has a particle diameter of 3 to 7 μm, 0.1 to 0.5 g of the toner should be included in the dispersion so that the dispersion has a concentration of 5,000 to 15,000 particles per micro-liter.

The toner according to an embodiment has a shape factor SF-1 of 100 to 150 and another shape factor SF-2 of 100 to 140, which means that the toner has a nearly spherical shape suitable for securing a core-shell structure.

The shape factors SF-1 and SF-2 may be measured as follows. Obtain images of 300 randomly-selected toner particles by a field emission scanning electron microscope FE-SEM S-4200 (from Hitachi, Ltd.). Analyze the images by an image analyzer LUZEX AP (from Nireco Corporation) through an interface and calculate SF-1 and SF-2 based on the following formulae:

$$SF\text{-}1=(L^2/A)\times(\pi/4)\times 100$$

$$SF\text{-}2=(P^2/A)\times(1/4\pi)\times 100$$

wherein L represents an absolute maximum length of a projected toner particle, A represents an area of the projected toner particle, and P represents a peripheral length of the projected toner particle. SF-1 and SF-2 are both 100 when the particle shape is complete sphere. SF-1 and SF-2 become greater than 100 as the particle shape becomes far away from complete sphere. SF-1 represents the degree of roundness of a toner particle and SF-2 represents the degree of asperity of the surface of a toner particle.

The toner according to an embodiment has a weight average particle diameter (D4) of 2 to 7 μm or 2 to 5 μm. The ratio (D4/Dn) of the weight average particle diameter (D4) to the number average particle diameter (Dn) of the toner is between 1.00 and 1.25 or between 1.00 and 1.15. When the ratio (D4/Dn) is between 1.00 and 1.25, the toner has a good combination of chargeability, developability, transferability, and fixability while forming a core-shell structure.

The following is one example procedure for measuring the weight average particle diameter (D4) and the number average particle diameter (Dn). Usable measuring instruments include COULTER COUNTER TA-II and COULTER MULTIZIZER II (both from Beckman Coulter, Inc.).

First, add 0.1 to 5 mL of a surfactant (e.g., a polyoxyethylene alkyl ether (nonionic surfactant)) to 100 to 150 mL of an electrolyte solution. The electrolyte solution is an aqueous solution of about 1% by weight of a first grade sodium chloride, such as ISOTON-II (from Beckman Coulter, Inc.). Next, add 2 to 20 mg of a toner to the electrolyte solution. Subject the electrolyte solution containing the toner to a dispersion treatment using an ultrasonic disperser for about 1 to 3 minutes to prepare a suspension. Subject the suspension to a measurement of volume and number distributions of toner particles using the above measuring instrument equipped with a 100-μm aperture. Calculate the weight average particle diameter (D4) and the number average particle diameter (D1) from the volume and number distributions measured above.

The following 13 channels are employed during the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Accordingly, particles having a particle diameter of not less than 2.00 μm and less than 40.30 μm are objects to be measured.

According to an embodiment, the toner may be produced by: dissolving or dispersing toner components including a crystalline polyester, a polyester prepolymer having an isocyanate group, a compound having an amino group, a colorant, and a release agent in an organic solvent, to prepare a toner components liquid; emulsifying the toner components liquid in an aqueous medium containing resin particles to prepare an emulsion; and removing the organic solvent from the emulsion.

The aqueous medium may be, for example, water alone or a mixture of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The aqueous medium contains resin particles. The resin particles function as a particle diameter controller during the emulsification and are finally allocated on the surfaces of resulting mother toner particles forming a shell. The shell property depends on particle diameter and chemical composition of the resin particles as well as properties of surfactants in the aqueous medium.

According to an embodiment, the toner may be produced by forming an aqueous dispersion of a polyester prepolymer (A) having an isocyanate group while reacting the polyester prepolymer (A) with an amine (B). To form a stable aqueous dispersion of the polyester prepolymer (A), the polyester prepolymer (A) is previously dissolved or dispersed in an organic solvent, and the resulting organic solvent solution or dispersion of the polyester prepolymer (A) is then dispersed (or emulsified) in an aqueous medium while applying a shearing force thereto. The organic solvent solution or dispersion of the polyester prepolymer (A) may be mixed with other toner components, such as a colorant or a colorant master batch, a release agent, a charge controlling agent, and an unmodified polyester, at the time being dispersed (or emulsified) in the aqueous medium. Alternatively, all the toner components may be previously mixed with each other and then dissolved or dispersed in an organic solvent, so that the resulting solution or dispersion of the toner components is dispersed (or emulsified) in the aqueous medium at once. The toner components such as colorant, release agent, and charge controlling agent are not necessarily included in the organic solvent solution or dispersion of the polyester prepolymer (A) at the time it is dispersed (or emulsified) in the aqueous medium, and may be added to the resulting particles in a later process. For example, the resulting particles including no colorant can be dyed with a colorant in a later process.

The organic solvent solution or dispersion of toner components (hereinafter "toner components liquid") is dispersed (or emulsified) in the aqueous medium using a low-speed shearing disperser, a high-speed shearing disperser, a frictional disperser, a high-pressure jet disperser, or an ultrasonic disperser, for example. In some embodiments, a high-speed shearing disperser is used to make the dispersing liquid droplets have an average particle diameter of 2 to 20 μm. In such embodiments, the high-speed shearing disperser operates at a revolution of 1,000 to 30,000 rpm or 5,000 to 20,000 rpm. In some embodiments, the dispersing time is 0.1 to 5 minutes for a batch type disperser. In some embodiments, the dispersing temperature is 0 to 150° C. (under pressure) or 40 to 98° C. As the temperature becomes higher, the viscosity of the toner components liquid becomes lower, which is easier to disperse in the aqueous medium.

In some embodiments, the amount of the aqueous medium is 50 to 2,000 parts by weight or 100 to 1,000 parts by weight, based on 100 parts by weight of toner components including the polyester prepolymer (A) having an isocyanate group. When the amount of the aqueous medium is less than 50 parts by weight, the toner components may not be finely dispersed and the resulting toner particles may not have a desired particle size. When the amount of the aqueous medium is greater than 2,000 parts by weight, manufacturing cost may increase. The aqueous medium may contain a dispersant. The dispersant stabilizes the dispersion and makes the resulting particles have a narrower size distribution.

Specific examples of usable dispersants include, but are not limited to, anionic surfactants such as alkylbenzene sulfonate, α-olefin sulfonate, and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi(aminoethyl) glycine, di(octylaminoethyl) glycine, and N-alkyl-N,N-dimethyl ammonium betaine.

Surfactants having a fluoroalkyl group can achieve an effect in a small amount. Specific examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of commercially available anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of usable cationic surfactants having a fluoroalkyl group include, but are not limited to, aliphatic primary, secondary, and tertiary amine acids having a fluoroalkyl group; aliphatic quaternary ammonium salts such as perfluoroalkyl(C6-C10) sulfonamide propyl trimethyl ammonium salts; benzalkonium salts; benzethonium chlorides; pyridinium salts; and imidazolinium salts. Specific examples of commercially available cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Poorly-water-soluble inorganic compounds such as tricalcium phosphate, calcium carbonate, titanium oxide, colloidal silica, and hydroxyapatite are also usable as the dispersant.

The aqueous medium may further contain a polymeric protection colloid to stabilize dispersing liquid droplets. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which a dispersant soluble in acids and bases (e.g., calcium phosphate) is used, the resulting mother particles may be first washed with an acid (e.g., hydrochloric acid) and then washed with water to remove the dispersant. Alternatively, such a dispersant can be removed with an enzyme.

In some embodiments, dispersants keep remaining on the surface of the mother particle. In some embodiments, dispersants are removed from the surface of the mother particle in terms of chargeability.

In some embodiments, the elongation and/or cross-linking reaction time between the polyester prepolymer (A) and the amine (B) is 10 minutes to 40 hours or 2 to 24 hours. In some embodiments, the reaction temperature is 0 to 150° C. or 40 to 98° C. A catalyst can be used in the reaction, if needed. Specific examples of usable catalysts include, but are not limited to, dibutyltin laurate and dioctyltin laurate.

The organic solvent can be removed from the emulsion by gradually heating the emulsion to completely evaporate the organic solvent from liquid droplets. Alternatively, the organic solvent can be removed from the emulsion by spraying the emulsion into dry atmosphere to completely evaporate the organic solvent from liquid droplets. In this case, aqueous dispersants, if any, can also be evaporated. The dry atmosphere into which the emulsion is sprayed may be, for example, air, nitrogen gas, carbon dioxide gas, or combustion gas, which is heated to above the maximum boiling point among the used solvents. Such a treatment can be reliably performed by a spray drier, a belt drier, or a rotary kiln, within a short period of time.

The organic solvent can also be removed by flowing air using a rotary evaporator.

The emulsion from which the organic solvent has been removed is then repeatedly subjected to a set of processes including crude centrifugal separation, washing in a tank, and drying by a hot air drier. Thus, mother particles are obtained.

The mother particles may be subjected to aging. In some embodiments, the aging temperature is 30 to 55° C. or 40 to 50° C. and the aging time is 5 to 36 hours or 10 to 24 hours.

In a case in which the emulsion is subjected to washing and drying treatments while containing mother particles having a wide size distribution, the mother particles may be subjected to a classification treatment thereafter.

In the classification treatment, undesired-size particles are removed from the emulsion by cyclone separation, decantation, or centrifugal separation, i.e., in wet conditions. Alternatively, the classification treatment can be performed after the emulsion is dried and mother particles are obtained, i.e., in dry conditions. The collected undesired-size particles, either in dry or wet condition, can be reused for preparation of toner particles.

The dispersant may be removed from the emulsion as soon as possible, for example, in the process of the classification treatment.

Finally, the mother particles are mixed with an external additive (e.g., inorganic fine particles) by a mixer (e.g., HENSCHEL MIXER) and coarse particles are removed therefrom by ultrasonic sieving. Thus, a toner is obtained.

A two-component developer according to an embodiment includes the toner according to an embodiment and a magnetic carrier. The two-component developer according to an embodiment can be frictionally charged to a predetermined level in a short amount of time, thus keeping a narrow charge distribution.

In some embodiments, the two-component developer includes 100 parts by weight of a magnetic carrier and 1 to 100 parts by weight of the toner. The magnetic carrier may be comprised of, for example, iron powder, ferrite powder, magnetite powder, and magnetic resin particles, having a particle diameter of about 20 to 200 μm. Specific examples of suitable covering materials for the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins. The covering material may contain a conductive powder therein. Specific examples of usable conductive powders include, but are not limited to, metal, carbon black, titanium oxide, tin oxide, and zinc oxide. In some embodiments, the conductive powder has an average particle diameter of 1 μm or less. When the average particle diameter is greater than 1 μm, it may be difficult to control electric resistivity of the covering resin layer.

The toner may also be used as a magnetic or non-magnetic one-component developer consisting of the toner and no carrier.

FIG. 1 is a schematic view illustrating a process cartridge according to an embodiment. A process cartridge (a) includes a photoreceptor (b), a charger (c), a developing device (d), and a cleaner (e).

The process cartridge according to an embodiment integrally supports at least the photoreceptor (b) and the developing device (d) and is detachably attachable to image forming apparatuses.

Figure 2:
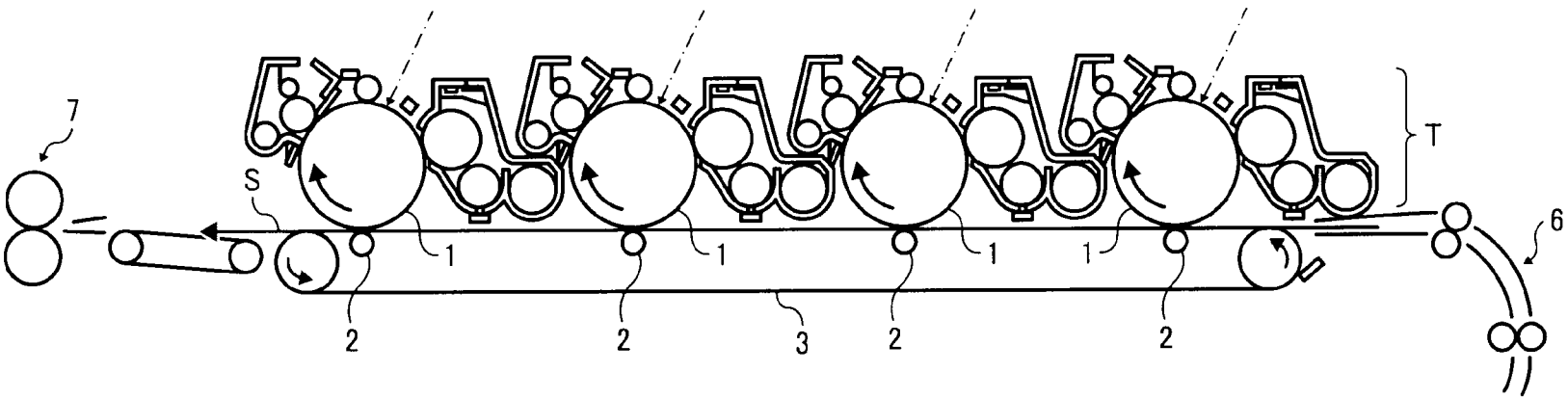
FIG. 2 is a schematic view illustrating a tandem image forming apparatus according to an embodiment, which employs a direct transfer method.
Figure 3:
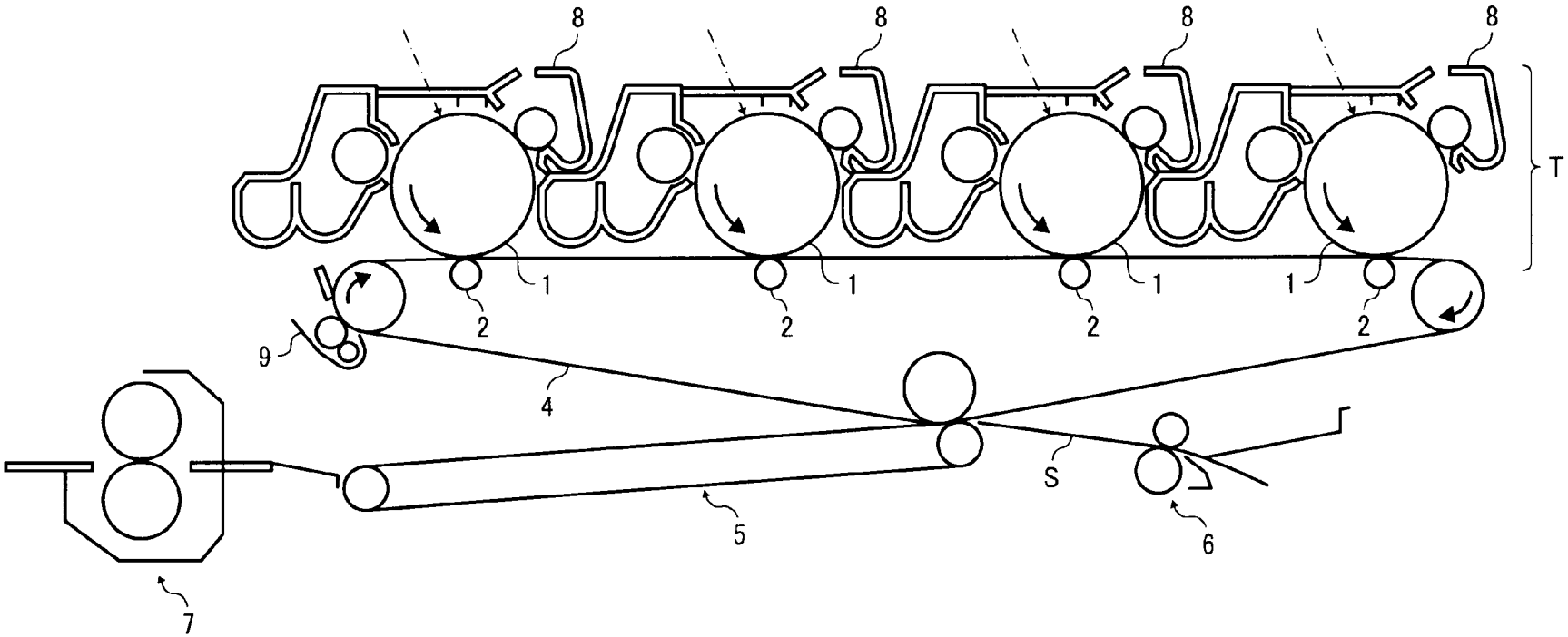
FIG. 3 is a schematic view illustrating a tandem image forming apparatus according to an embodiment, which employs an indirect transfer method.

According to an embodiment, the present invention provides a tandem full-color image forming apparatus in which four developing units are disposed in tandem. FIG. 2 is a schematic view illustrating a tandem image forming apparatus according to an embodiment, which employs a direct transfer method. In FIG. 2, each transfer device 2 sequentially transfer a toner image from corresponding photoreceptor 1 directly onto a sheet s conveyed by a sheet conveyance belt 3. FIG. 3 is a schematic view illustrating a tandem image forming apparatus according to an embodiment, which employs an indirect transfer method. In FIG. 3, each primary transfer device 2 sequentially transfer a toner image from corresponding photoreceptor 1 onto an intermediate transfer member 4 to form a composite toner image thereon. A secondary transfer device 5 then transfers the composite toner image from the intermediate transfer member 4 onto a sheet S. The secondary transfer device 5 may be either in the form of belt or roller.

In the direct transfer method illustrated in FIG. 2, a paper feeder 6 and a fixing device 7 should be respectively disposed upstream and downstream from a tandem image forming unit T comprising the photoreceptors 1, thus making the image forming apparatus larger in a direction of conveyance of sheet.

By contrast, in the indirect transfer method illustrated in FIG. 3, the position of the secondary transfer device 5 is relatively free. Therefore, the paper feeder 6 and the fixing device 7 can be disposed overlapping the tandem image forming unit T, making the image forming apparatus more compact.

The image forming apparatus illustrated in FIG. 3 further includes photoreceptor cleaners 8 that remove residual toner particles remaining on the photoreceptors 1 after the primary transfer; and an intermediate transfer member cleaner 9 that removes residual toner particles remaining on the intermediate transfer member 4 after the secondary transfer.

Figure 4:
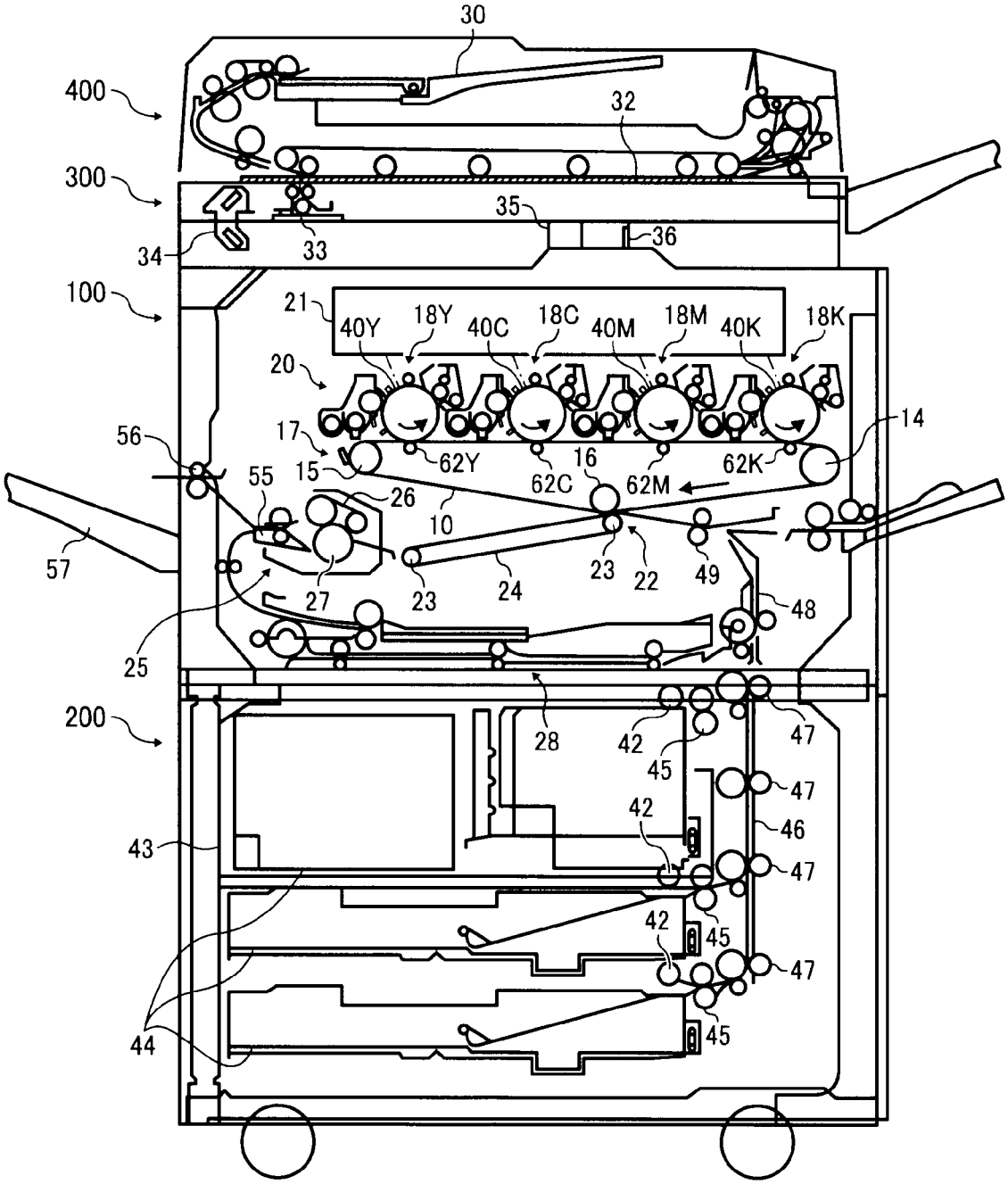
FIG. 4 is a schematic view illustrating another tandem image forming apparatus according to an embodiment, which employs an indirect transfer method.

FIG. 4 is a schematic view illustrating another tandem image forming apparatus according to an embodiment, which employs an indirect transfer method. The image forming apparatus includes a main body 100, a paper feed table 200 disposed below the main body 100, a scanner 300 disposed above the main body 100, and an automatic document feeder (ADF) 400 disposed above the scanner 300. A seamless-belt intermediate transfer member 10 is disposed at the center of the main body 100.

The intermediate transfer member 10 is stretched across support rollers 14, 15, and 16 to be rotatable clockwise in FIG. 4.

An intermediate transfer member cleaner 17 that removes residual toner particles remaining on the intermediate transfer member 10 is disposed on the left side of the support roller 15 in FIG. 4.

Image forming units 18Y, 18C, 18M, and 18K that produce respective images of black, yellow, magenta, and cyan are disposed along a stretched surface of the intermediate transfer member 10 between the support rollers 14 and 15, thus forming a tandem image forming part 20.

An irradiator 21 is disposed immediately above the tandem image forming part 20. A secondary transfer device 22 is disposed on the opposite side of the tandem image forming part 20 relative to the intermediate transfer member 10. The secondary transfer device 22 includes a seamless secondary transfer belt 24 stretched between two rollers 23. The secondary transfer belt 24 is pressed against the support roller 16 with the intermediate transfer member 10 therebetween so that an image is transferred from the intermediate transfer member 10 onto a sheet of a recording medium.

A fixing device 25 that fixes a toner image on the sheet is disposed adjacent to the secondary transfer device 22. The fixing device 25 includes a seamless fixing belt 26 and a pressing roller 27. The fixing belt 26 is pressed against the pressing roller 27.

The secondary transfer device 22 has a function of feeding the sheet having the toner image thereon to the fixing device 25. The secondary transfer device 22 may be, for example, a transfer roller or a non-contact charger.

A sheet reversing device 28 that reverses a sheet upside down is disposed below the secondary transfer device 22 and the fixing device 25 while being in parallel with the tandem image forming part 20.

To make a copy, a document is set on a document table 30 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to a document, and reflects a light reflected from the document toward the second runner 24. A mirror in the second runner 34 reflects the light toward a reading sensor 36 through an imaging lens 35. Thus, the document is read. On the other hand, upon pressing of the switch, one of the support rollers 14, 15, and 16 is driven to rotate by a driving motor and the other two support rollers are driven to rotate by rotation of the rotating support roller so as to rotate and convey the intermediate transfer member 10. In the image forming units 18Y, 18C, 18M, and 18K, single-color toner images of yellow, magenta, cyan, and black are formed on photoreceptors 40Y, 40C, 40M, and 40K, respectively. The single-color toner images are sequentially transferred onto the intermediate transfer member 10 along conveyance of the intermediate transfer member 10 to form a composite full-color toner image thereon. On the other hand, upon pressing of the switch, one of paper feed rollers 42 starts rotating in the paper feed table 200 so that a sheet of a recording paper is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is stopped by a registration roller 49.

The registration roller 49 feeds the sheet to between the intermediate transfer member 10 and the secondary transfer device 22 in synchronization with an entry of the composite full-color toner image formed on the intermediate transfer member 10.

The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56.

On the other hand, the intermediate transfer member cleaner 17 removes residual toner particles remaining on the intermediate transfer member 10 without being transferred. Thus, the tandem image forming part 20 gets ready for next image formation.

Although the registration roller 49 is generally grounded, the registration roller 49 is applicable with a bias for the purpose of removing paper powders from the sheet.

Figure 5:
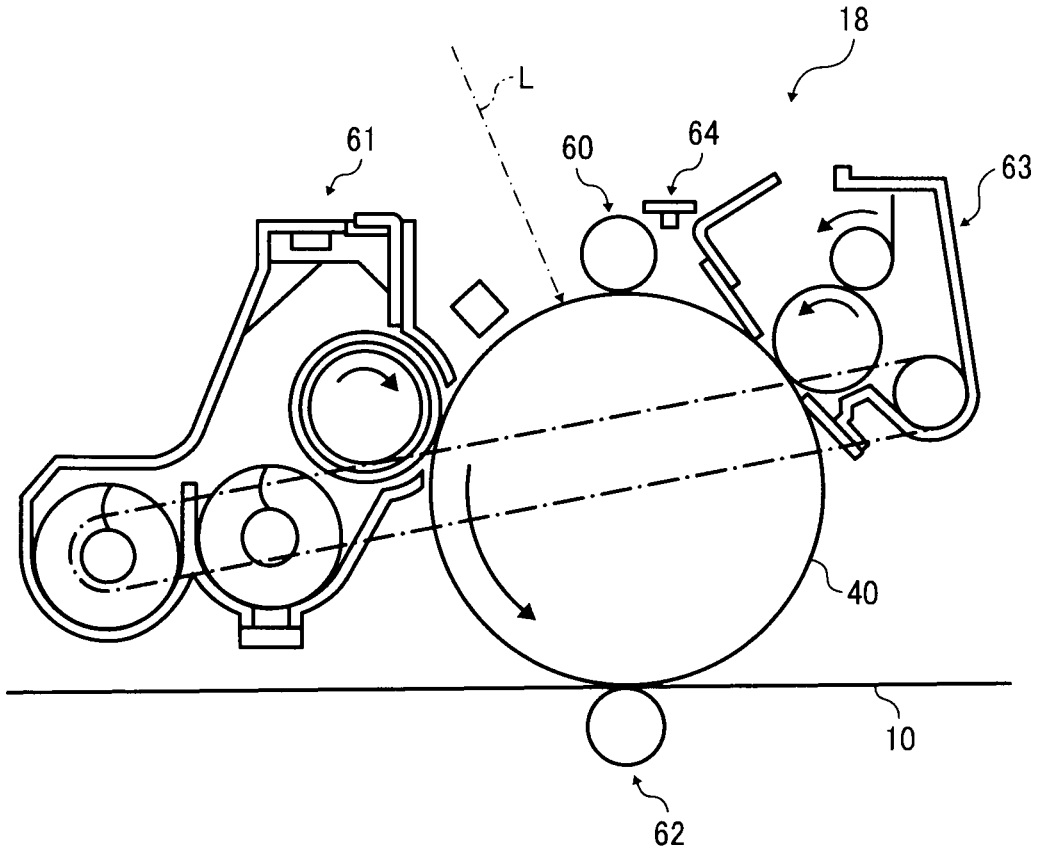
FIG. 5 is a magnified schematic view illustrating one of the image forming units included in the image forming apparatus illustrated in FIG. 4.

FIG. 5 is a magnified schematic view illustrating one of the image forming units 18. The image forming unit 18 includes a photoreceptor 40; and a charger 60, a developing device 61, a primary transfer device 62, a photoreceptor cleaner 63, and a neutralizer 64, disposed around the photoreceptor 40.

In some embodiments, the image forming apparatus has a system speed of 500 to 2,500 mm/sec.

The system speed Y (mm/sec) can be determined from the following formula:

$$Y\,(\text{mm/sec})=100\,(\text{sheets})\times 297\,(\text{mm})/X\,(\text{sec})$$

wherein X represents a length of time it takes for an image forming apparatus to continuously output 100 sheets of A4 paper (having a longitudinal length of 297 mm) in a longitudinal direction.

In some embodiments, the fixing medium (e.g., the fixing belt 26) applies pressure to a recording medium at a surface pressure of 5 to 90 N/cm$^2$, so that toner images can be strongly fixed on a recording medium even when a supplied thermal energy is insufficient, i.e., the printing speed is high and/or the fixing temperature is low. The surface pressure of a fixing medium can be measured with a pressure distribution measurement system PINCH (from Nitta Corporation).

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Vinyl Resin Particle Emulsion

A reaction vessel equipped with a condenser, a stirrer, a nitrogen inlet pipe, and a thermometer was charged with raw materials for Vinyl Resin Particle Emulsion 1 described in Table 1. The raw materials were heated to 80° C. while being agitated under nitrogen atmosphere and kept at 80° C. for 8 hours. Thus, a vinyl resin particle emulsion 1 was prepared.

TABLE 1

| | | Vinyl Resin Particle Emulsion 1 | Vinyl Resin Particle Emulsion 2 | Vinyl Resin Particle Emulsion 3 |
|---|---|---|---|---|
| Raw Materials (parts) | Styrene | 600 | 600 | 600 |
| | n-BMA | 100 | 100 | 100 |
| | Divinylbenzene | 5 | 7 | 10 |
| | BPO (Benzoyl peroxide) | 20 | 20 | 17 |
| | Ion-exchange Water | 1,500 | 1,500 | 1,500 |
| | Sodium Dodecylbenzene Sulfonate | 10 | 10 | 10 |
| Reaction Temperature (° C.) | | 80 | 80 | 80 |
| Gas | | $N_2$ | $N_2$ | $N_2$ |

The vinyl resin particle emulsion 1 had a volume average particle diameter of 330 nm when measured by a laser diffraction particle size distribution analyzer LA-920 (from Horiba, Ltd.). A part of the vinyl resin particle emulsion 1 was dried to isolate the vinyl resin. The isolated vinyl resin had a glass transition temperature of 69° C. and a peak average molecular weight of 16,000.

Preparation of Aqueous Phase

An aqueous phase 1 was prepared by mixing 990 parts of water, 83 parts of the vinyl resin particle emulsion 1, 37 parts of a 48.3% aqueous solution of dodecyl diphenyl ether sodium disulfonate (ELEMINOL MON-7 from Sanyo Chemical Industries, Ltd.), and 90 parts of ethyl acetate. The aqueous phase 1 was a milky whitish liquid.

Preparation of Amorphous Unmodified Polyester

A reaction vessel equipped with a condenser, a stirrer, and a nitrogen inlet pipe was charged with 229 parts of ethylene oxide 2 mol adduct of bisphenol A, 329 parts of propylene oxide 3 mol adduct of bisphenol A, 188 parts of terephthalic acid, 100 parts of adipic acid, and 2 parts of dibutyltin oxide. The mixture was subjected to reaction for 8 hours at 230° C. under normal pressures. The mixture was further subjected to reaction for 5 hours under reduced pressures of 10 to 15 mmHg. After adding 35 parts of trimellitic anhydride, the mixture was further subjected to reaction for 2 hours at 180° C. under normal pressures. Thus, an amorphous unmodified polyester 1 was prepared. The amorphous unmodified polyester 1 had a number average molecular weight of 2,600, a weight average molecular weight of 4,000, a glass transition temperature (Tg) of 45° C., and an acid value of 25 mgKOH/g.

Preparation of Crystalline Polyester

A reaction vessel equipped with a condenser, a stirrer, and a nitrogen inlet pipe was charged with 1,170 parts of 1,6-hexanediol, 23.7 parts of sodium dimethyl 5-sulfoisophthalate, 22.8 parts of dimethyl fumarate, 857 parts of dimethyl sebacate, and 0.4 parts of dibutyltin oxide. To make an inert atmosphere in the reaction vessel, the air was replaced with nitrogen gas by pressure reduction. Thereafter, the mixture was mechanically agitated for 5 hours at 180 rpm. The mixture was gradually heated to 220° C. under reduced pressures and agitated for 2 hours until the mixture became tenacious. The mixture was then air-cooled to terminate the reaction. Thus, a crystalline polyester 1 was prepared. The crystalline polyester 1 had a number average molecular weight of 3,600, a weight average molecular weight of 6,800, and a melting point of 70° C.

Preparation of Prepolymer

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to reaction for 7 hours at 230° C. under normal pressures. The mixture was further subjected to reaction for 5 hours under reduced pressures of 10 to 15 mmHg. Thus, an amorphous intermediate polyester 1 was prepared. The amorphous intermediate polyester 1 had a number average molecular weight of 2,200, a weight average molecular weight of 9,700, a glass transition temperature (Tg) of 54° C., an acid value of 0.5 mgKOH/g, and a hydroxyl value of 52 mgKOH/g.

Another reaction vessel equipped with a condenser, a stirrer, and a nitrogen inlet pipe was charged with 410 parts of the amorphous intermediate polyester 1, 89 parts of isophorone diisocyanate, and 500 parts of ethyl acetate. The mixture was subjected to reaction for 5 hours at 100° C. Thus, a prepolymer 1 was prepared. The prepolymer 1 was including 1.53% of free isocyanates.

Preparation of Ketimine

A reaction vessel equipped with a stirrer and a thermometer was charged with 170 parts of isophoronediamine and 75 parts of methyl ethyl ketone. The mixture was subjected to reaction for 4.5 hours at 50° C. Thus, a ketimine compound I was prepared. The ketimine compound I had an amine value of 417 mgKOH/g.

Preparation of Master Batch

First, 1,200 parts of water, 540 parts of a carbon black having a DBP oil absorption of 42 ml/100 g and a pH of 9.5 (PRINTEX 35 from Degussa), and 1,200 parts of a polyester resin were mixed using a HENSCHEL MIXER (from Nippon Coke & Engineering Co., Ltd.). The resulting mixture was kneaded for 1 hour at 110° C. using a double roll, the kneaded mixture was then rolled and cooled, and the rolled mixture was then pulverized into particles using a pulverizer. Thus, a master batch 1 was prepared.

Preparation of Oil Phase

A reaction vessel equipped with a stirrer and a thermometer was charged with 222 parts of the amorphous unmodified polyester 1, 156 parts of the crystalline polyester 1, 130 parts of a carnauba wax, and 947 parts of ethyl acetate. The mixture was heated to 80° C. while being agitated, kept at 80° C. for 5 hours, and cooled to 30° C. over a period of 1 hour. The mixture was further mixed with 500 parts of the master batch 1 and 500 parts of ethyl acetate for 1 hour.

Thereafter, 1,324 parts of the resulting mixture was subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Further, 1,324 parts of a 65% ethyl acetate solution of the amorphous unmodified polyester 1 were added, and the resulting mixture was subjected to the above dispersing operation for 5 times (5 passes). Thus, a colorant wax dispersion 1 was prepared. The colorant wax dispersion 1 was containing solid components in an amount of 50% by weight.

Emulsification and Solvent Removal

The colorant wax dispersion 1 in an amount of 749 parts, the prepolymer 1 in an amount of 115 parts, and the ketimine compound 1 in an amount of 2.9 parts were contained in a vessel and mixed by a TK HOMOMIXER (from PRIMIX Corporation) for 2 minutes at 5,000 rpm. The aqueous phase 1 in an amount of 1,200 parts was further added to the vessel and mixed by a TK HOMOMIXER at a revolution of 13,000 rpm for 25 minutes. Thus, an emulsion slurry 1 was prepared.

The emulsion slurry 1 was contained in a vessel equipped with a stirrer and a thermometer, and subjected to solvent removal for 8 hours at 30° C. and subsequent aging for 24 hours at 40° C. Thus, a dispersion slurry 1 was prepared.

Washing and Drying

The dispersion slurry 1 in an amount of 100 parts was filtered under reduced pressures, and mixed with 100 parts of ion-exchange water using a TK HOMOMIXER for 10 minutes at a revolution of 12,000 rpm, followed by filtering, thus obtaining a wet cake (i). The wet cake (i) was mixed with 100 parts of a 10% aqueous solution of sodium hydroxide using a TK HOMOMIXER for 30 minutes at a revolution of 12,000 rpm, followed by filtering under reduced pressures, thus obtaining a wet cake (ii). The wet cake (ii) was mixed with 100 parts of a 10% hydrochloric acid using a TK HOMOMIXER for 10 minutes at a revolution of 12,000 rpm, followed by filtering, thus obtaining a wet cake (iii). The wet cake (iii) was mixed with 300 parts of ion-exchange water using a TK HOMOMIXER for 10 minutes at a revolution of 12,000 rpm, followed by filtering. This operation was repeated twice, thus obtaining a wet cake (iv).

The wet cake (iv) was dried by a drier for 48 hours at 45° C., and filtered with a mesh having openings of 75 μm. Thus, a mother toner 1 was prepared.

The mother toner 1 in an amount of 100 parts was mixed with 1 part of a hydrophobized silica having a particle diameter of 13 nm by a HENSCHEL MIXER. Thus, a toner 1 was prepared.

Example 2

A vinyl resin particle emulsion 2 was prepared in the same manner as the vinyl resin particle emulsion 1 except for replacing raw materials as described in Table 1. The procedure for preparing the toner 1 in Example 1 was repeated except for replacing the vinyl resin particle emulsion 1 with the vinyl resin particle emulsion 2. Thus, a toner 2 was prepared.

The vinyl resin particle emulsion 2 had a volume average particle diameter of 220 nm. The dried vinyl resin isolated from the vinyl resin particle emulsion 2 had a glass transition temperature (Tg) of 66° C. and a peak average molecular weight of 130,000.

Example 3

A vinyl resin particle emulsion 3 was prepared in the same manner as the vinyl resin particle emulsion 1 except for replacing raw materials as described in Table 1. The procedure for preparing the toner 1 in Example 1 was repeated except for replacing the vinyl resin particle emulsion 1 with the vinyl resin particle emulsion 3. Thus, a toner 3 was prepared.

The vinyl resin particle emulsion 3 had a volume average particle diameter of 170 nm. The dried vinyl resin isolated from the vinyl resin particle emulsion 3 had a glass transition temperature (Tg) of 63° C. and a peak average molecular weight of 9,000.

Example 4

The procedure for preparing the toner 1 in Example 1 was repeated except for replacing the aqueous phase 1 with an aqueous phase 2 prepared as follows. Thus, a toner 4 was prepared.

The aqueous phase 2 was prepared by mixing 990 parts of water, 160 parts of the vinyl resin particle emulsion 1, 37 parts of a 48.3% aqueous solution of dodecyl diphenyl ether sodium disulfonate (ELEMINOL MON-7 from Sanyo Chemical Industries, Ltd.), and 90 parts of ethyl acetate. The aqueous phase 2 was a milky whitish liquid.

Comparative Example 1

The procedure for preparing the toner 1 in Example 1 was repeated except for replacing the vinyl resin particle emulsion 1 and the aqueous phase 1 with a vinyl resin particle emulsion 4 and an aqueous phase 3, respectively, prepared as follows. Thus, a comparative toner 1 was prepared.

A reaction vessel equipped with a stirrer and a thermometer was charged with 683 parts of water, 11 parts of a sodium salt of a sulfate of ethylene oxide adduct of methacrylic acid (ELEMINOL RS-30 from Sanyo Chemical Industries, Ltd.), 166 parts of methacrylic acid, 110 parts of butyl acrylate, and 1 part of ammonium persulfate. The mixture was agitated for 30 minutes at a revolution of 3,800 rpm, thus preparing a white emulsion. The white emulsion was heated to 75° C. and subjected to reaction for 4 hours. A 1% aqueous solution of ammonium persulfate in an amount of 30 parts was further added to the emulsion, and the mixture was aged for 6 hours at 75° C. Thus, the vinyl resin particle emulsion 4 that is an aqueous dispersion of a vinyl resin (i.e., a copolymer of methacrylic acid, butyl acrylate, and a sodium salt of a sulfate of ethylene oxide adduct of methacrylic acid) was prepared. The vinyl resin particle emulsion 4 had a volume average particle diameter of 110 nm when measured by the laser diffraction particle size distribution analyzer LA-920 (from Horiba, Ltd.). The dried vinyl resin isolated from the vinyl resin particle emulsion 4 had a glass transition temperature (Tg) of 58° C. and a weight average molecular weight of 130,000.

The aqueous phase 3 was prepared by mixing 990 parts of water, 40 parts of the vinyl resin particle emulsion 4, 37 parts of a 48.3% aqueous solution of dodecyl diphenyl ether sodium disulfonate (ELEMINOL MON-7 from Sanyo Chemical Industries, Ltd.), and 90 parts of ethyl acetate. The aqueous phase 3 was a milky whitish liquid.

Comparative Example 2

The procedure for preparing the toner 1 in Example 1 was repeated except for replacing the vinyl resin particle emulsion 1 and the aqueous phase 1 with a vinyl resin particle emulsion 5 and an aqueous phase 4, respectively, prepared as follows. Thus, a comparative toner 2 was prepared.

A reaction vessel equipped with a stirrer and a thermometer was charged with 683 parts of water, 11 parts of a sodium salt of a sulfate of ethylene oxide adduct of methacrylic acid (ELEMINOL RS-30 from Sanyo Chemical Industries, Ltd.), 166 parts of methacrylic acid, 70 parts of butyl acrylate, and 1 part of ammonium persulfate. The mixture was agitated for 20 minutes at a revolution of 1,500 rpm, thus preparing a white emulsion. The white emulsion was heated to 75° C. and subjected to reaction for 3 hours. A 1% aqueous solution of ammonium persulfate in an amount of 30 parts was further added to the emulsion, and the mixture was aged for 12 hours at 65° C. Thus, the vinyl resin particle emulsion 5 that is an aqueous dispersion of a vinyl resin (i.e., a copolymer of methacrylic acid, butyl acrylate, and a sodium salt of a sulfate of ethylene oxide adduct of methacrylic acid) was prepared. The vinyl resin particle emulsion 5 had a volume average particle diameter of 680 nm when measured by the laser diffraction particle size distribution analyzer LA-920 (from Horiba, Ltd.). The dried vinyl resin isolated from the vinyl resin particle emulsion 5 had a glass transition temperature (Tg) of 58° C. and a weight average molecular weight of 130,000.

The aqueous phase 4 was prepared by mixing 990 parts of water, 180 parts of the vinyl resin particle emulsion 5, 37 parts of a 48.3% aqueous solution of dodecyl diphenyl ether sodium disulfonate (ELEMINOL MON-7 from Sanyo Chemical Industries, Ltd.), and 90 parts of ethyl acetate. The aqueous phase 4 was a milky whitish liquid.

Comparative Example 3

The procedure in Example 2 was repeated except for replacing the amorphous unmodified polyester 1 with an amorphous unmodified polyester 4 prepared as follows. Thus, a comparative toner 3 was prepared.

A reaction vessel equipped with a condenser, a stirrer, and a nitrogen inlet pipe was charged with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. The mixture was subjected to reaction for 10 hours at 230° C. under normal pressures. The mixture was further subjected to reaction for 8 hours under reduced pressures of 10 to 15 mmHg. After adding 70 parts of trimellitic anhydride, the mixture was further subjected to reaction for 3 hours at 180° C. under normal pressures. Thus, the amorphous unmodified polyester 4 was prepared. The amorphous unmodified polyester 4 had a number average molecular weight of 2,800, a weight average molecular weight of 7,300, a glass transition temperature (Tg) of 47° C., and an acid value of 25 mgKOH/g.

Comparative Example 4

The procedure in Example 2 was repeated except for replacing the amorphous unmodified polyester 1 with an amorphous unmodified polyester 5 prepared as follows. Thus, a comparative toner 4 was prepared.

A reaction vessel equipped with a condenser, a stirrer, and a nitrogen inlet pipe was charged with 430 parts of propylene oxide 2 mol adduct of bisphenol A, 300 parts of propylene oxide 3 mol adduct of bisphenol A, 257 parts of terephthalic acid, 65 parts of isophthalic acid, and 10 parts of maleic anhydride. The mixture was subjected to reaction for 5 hours at 150° C. in nitrogen atmosphere while reducing the produced water. After the pressure was reduced to 5 to 20 mmHg and the acid value became 5 mgKOH/g, the mixture was cooled to room temperature and pulverized. Thus, the amorphous unmodified polyester 5 was prepared. The amorphous unmodified polyester 5 had an acid value of 7 mgKOH/g, a glass transition temperature (Tg) of 45° C., and a weight average molecular weight of 3,600.

Properties of the above-prepared toners are shown in Tables 2-1 and 2-2.

TABLE 2-1

| | H1 (μm) | H2 (μm) | D (μm) | Ra (μm) | Shell Thickness (μm) |
|---|---|---|---|---|---|
| Example 1 | 1.5 | 1.9 | 0.4 | 0.4 | 0.7 |
| Example 2 | 0.9 | 1.7 | 0.8 | 0.3 | 0.2 |
| Example 3 | 0.5 | 1.5 | 1.0 | 0.02 | 0.01 |
| Example 4 | 1.5 | 1.6 | 0.1 | 0.3 | 2.2 |
| Comparative Example 1 | 1.6 | 2.9 | 1.3 | 0.1 | ND |
| Comparative Example 2 | 1.1 | 1.8 | 0.7 | 0.9 | 2.2 |
| Comparative Example 3 | 0.8 | 2.2 | 1.4 | 0.4 | 0.4 |
| Comparative Example 4 | 2.6 | 3.1 | 0.5 | 0.01 | 0.5 |

TABLE 2-2

| | Average Circularity E | Shape Factors | | Particle Size Properties | | |
|---|---|---|---|---|---|---|
| | | SF-1 | SF-2 | D4 (μm) | Dn (μm) | D4/Dn |
| Example 1 | 0.97 | 132 | 124 | 4.8 | 4.3 | 1.12 |
| Example 2 | 0.95 | 127 | 121 | 4.9 | 4.4 | 1.11 |
| Example 3 | 0.96 | 116 | 109 | 3.6 | 2.9 | 1.24 |
| Example 4 | 0.95 | 139 | 120 | 5.6 | 4.9 | 1.14 |
| Comparative Example 1 | 0.96 | 118 | 105 | 6.2 | 5.2 | 1.19 |
| Comparative Example 2 | 0.94 | 151 | 142 | 5.3 | 4.4 | 1.20 |
| Comparative Example 3 | 0.91 | 162 | 154 | 6.8 | 5.9 | 1.15 |
| Comparative Example 4 | 0.92 | 159 | 148 | 5.9 | 4.6 | 1.28 |

Preparation of Carrier

A coating liquid was prepared by mixing 450 parts of toluene, 450 parts of a silicone resin SR2400 (from Dow Corning Toray Co., Ltd., containing 50% of nonvolatile contents), 10 parts of an aminosilane SH6020 (from Dow Corning Toray Co., Ltd.), and 10 parts of a carbon black, with a stirrer. The coating liquid was applied to 5,000 parts of Mn ferrite particles (having a weight average particle diameter of 35 μm) by a fluidized bed coater equipped with a rotary bottom disc and agitation blades that generates swirling flow. The ferrite particles having the coating were burnt in an electric furnace at 250° C. for 2 hours. Thus, a carrier was prepared.

Preparation of Two-Component Developers

The above-prepared carrier, i.e., ferrite carrier having an average particle diameter of 35 μm and a silicone resin coating having an average thickness of about 0.5 μm, in an amount of 100 parts was mixed with each of the above-prepared toners in an amount of 7 parts were mixed by a TURBULA MIXER, to prepare two-component developers.

Evaluations

The above-prepared toners were subjected to evaluations described below. The evaluation results were shown in Table 3.

TABLE 3

| | Low-temperature Fixability | Heat-resistant Storage Stability | Development Stability |
|---|---|---|---|
| Example 1 | B | B | A |
| Example 2 | B | B | B |
| Example 3 | A | C | B |
| Example 4 | C | A | A |
| Comparative Example 1 | C | D | D |
| Comparative Example 2 | D | A | A |
| Comparative Example 3 | D | D | D |
| Comparative Example 4 | A | D | D |

Preparation of Test Machine

A test machine was prepared by modifying an image forming apparatus MPC7500 (from Ricoh Co., Ltd.) as follows. The linear speed was set to 1,700 mm/sec, the developing gap was set to 1.26 mm, the doctor blade gap was set to 1.6 mm, and the reflective photosensor was powered off. The fixing surface pressure was set to 39 N/cm$^2$ and the fixing nip width was set to 10 mm. The surface of the fixing medium was conditioned by being applied with a tetrafluoroethylene-perfluoroalkyl vinyl ether resin (PFA). The image bearing member, developing device, and transfer device were controlled to have a real temperature of 30 to 45° C. The fixing roller temperature was set to 110° C.

Evaluation of Low-Temperature Fixability

Each of the two-component developers was set to the test machine. The test machine was operated so as to produce an image on sheets of a thick paper 135K (from Nippon Paper Group, Inc.) while varying the fixing roller temperature at an interval of 5° C.

The test machine was operated so that the fixed image had an image density of 1.2 when measured by X-RITE 938. The fixed images were subjected to rubbing for 50 times by a crock meter equipped with a sand eraser, and fixation retaining ability was determined from the following formula:

$$\text{Fixation Retaining Ability (\%)} = ID(A)/ID(B) \times 100$$

wherein ID(A) represents an image density after the rubbing and ID(B) represents an image density before the rubbing.

The minimum fixable temperature was defined as a temperature below which the fixation retaining ability was less than 70%. Low-temperature fixability was evaluated in terms of minimum fixable temperature as follows.

A: The minimum fixable temperature was not greater than 100° C.

B: The minimum fixable temperature was greater than 100° C. and not greater than 110° C.

C: The minimum fixable temperature was greater than 110° C. and not greater than 120° C.

D: The minimum fixable temperature was greater than 120° C.

Evaluation of Heat-Resistant Storage Stability

A 20-ml glass container was filled with 10 g of each toner and subjected to 100 times of tapping using a tapping apparatus. The glass container was let stand in a constant-temperature chamber at a temperature of 50° C. and a humidity of 80% for 72 hours. Thereafter, the toner was subjected to a penetration test (according to a description in a manual from Nikka Engineering Co., Ltd.) using a penetrometer.

Heat-resistant storage stability was graded into the following 4 levels in terms of penetration:

A: not less than 20 mm

B: not less than 15 mm and less than 20 mm

C: not less than 10 mm and less than 15 mm

D: less than 10 mm

Evaluation of Development Stability

Development stability was evaluated in an environmental test laboratory at a temperature of 50° C. and a humidity of 80% as follows. Each of the two-component developers was set to the test machine. The test machine was operated so as to perform a durability test in which an image chart having an image area ratio of 3% were continuously produced on 10,000 sheets of paper. Before and after the durability test, 1 g of the developer was subjected to a measurement of charge amount by a blow-off method, and the charge amount change before and after the durability test was calculated. In the blow-off method, the developer was contained in a cylindrical Faraday cage both ends of which were provided with a metallic mesh. The developer was blown off by high-pressure air to make toner particles release from the developer. The developer from which toner particles had been removed was subjected to a measurement of residual charge by an electrometer. The amount of the toner particles contained in the developer was calculated from the difference in weight of the Faraday cage before and after the blowing off. Similarly, another durability test in which an image chart having an image area ratio of 60% were continuously produced on 10,000 sheets of paper was performed and the charge amount change before and after the durability test was calculated. Development stability was evaluated in terms of charge amount change (rounded off to the closest whole number) determined in the two durability tests, whichever is greater.

A: The charge amount change was not greater than 3 μC/g.

B: The charge amount change was greater than 4 μC/g and not greater than 6 μC/g.

C: The charge amount change was greater than 7 μC/g and not greater than 10 μC/g.

D: The charge amount change was greater than 10 μgC/g.

Additional modifications and variations of the present invention are possible in light of the above teachings. It is therefore to be understood that within the scope of the appended claims the invention may be practiced other than as specifically described herein.

What is claimed is:

1. A toner, comprising:

a mother particle including:

a core including a crystalline polyester, an amorphous polyester, a colorant, and a release agent; and a shell including resin particles; and an external additive, wherein a deformation amount H1 of the toner compressed by a pressure of 0.5 mN under a temperature of 25° C. is between 0.2 and 1.5 μm, wherein a difference D between the deformation amount H1 and a deformation amount H2 of the toner compressed by a pressure of 0.5 mN under a temperature of 50° C. is between 0.0 and 1.0 μm, and wherein a surface roughness Ra of the toner melted at 90° C. is between 0.02 and 0.40 μm.

2. The toner according to claim 1, wherein the shell has a thickness of 0.01 to 2 μm.

3. The toner according to claim 1, wherein the toner is produced by a method comprising:

dissolving or dispersing toner components in an organic solvent, the toner components including the crystalline polyester, a polyester prepolymer having an isocyanate group, a compound having an amino group, the colorant, and the release agent, to prepare a toner components liquid;

emulsifying the toner components liquid in an aqueous medium containing the resin particles to prepare an emulsion; and removing the organic solvent from the emulsion.

4. The toner according to claim 1, wherein the toner has an average circularity E of 0.93 to 0.99.

5. The toner according to claim 1, wherein the toner has a shape factor SF-1 of 100 to 150 and another shape factor SF-2 of 100 to 140.

6. The toner according to claim 1, wherein the toner has a weight average particle diameter (D4) of 2 to 7 μm and a ratio (D4/Dn) of the weight average particle diameter (D4) to a number average particle diameter (Dn) of the toner is between 1.00 and 1.25.

7. A two-component developer, comprising;

the toner according to claim 1; and a magnetic carrier.

8. An image forming method, comprising:

forming a toner image on a recording medium with the toner according to claim 1; and fixing the toner image on the recording medium by applying a pressure of 5 to 90 $N/cm^2$ to the toner image.

9. The toner according to claim 1, wherein a resin of the resin particles in the shell has a weight average molecular weight of from 9000 to 16000.

10. The toner according to claim 1, wherein a resin of the resin particles in the shell includes divinylbenzene as a monomer.

* * * * *